United States Patent [19]

Donachiue

[11] 3,974,244

[45] Aug. 10, 1976

[54] HUMIDIFIER PAD

[76] Inventor: James P. Donachiue, Apartment 801,70 Park St., Port Credit, Ontario, Canada

[22] Filed: Aug. 21, 1975

[21] Appl. No.: 606,533

Related U.S. Application Data

[63] Continuation of Ser. No. 419,122, Nov. 26, 1973, abandoned.

[52] U.S. Cl. ..... 261/92; 428/89

[51] Int. Cl.[2] ..... B01F 3/04

[58] Field of Search ..... 55/234, 400, 464, 489, 55/484; 98/2.11, 104; 210/150, 151; 52/660; 428/88, 89; 261/80, 92, 99, 103, 112, 113, DIG. 15

[56] References Cited

UNITED STATES PATENTS

| | | | |
|---|---|---|---|
| 1,499,864 | 7/1924 | Gordon | 55/484 |
| 1,650,140 | 11/1927 | Kuhni | 261/99 |
| 1,868,107 | 7/1932 | Lachman, et al. | 52/660 X |
| 2,551,227 | 5/1951 | Yost | 261/92 X |
| 2,879,979 | 3/1959 | Wheeler | 261/92 |
| 3,285,586 | 11/1966 | Powers | 261/92 |
| 3,684,256 | 8/1972 | Barnes, Jr. et al. | 261/92 |
| 3,768,981 | 10/1973 | Alliger | 261/92 X |
| 3,773,306 | 11/1973 | Duquet | 261/92 |
| 3,821,064 | 6/1974 | Cima | 428/89 |
| 3,895,083 | 7/1975 | Yeagle | 261/92 |

*Primary Examiner*—Tim R. Miles
*Assistant Examiner*—Richard L. Chiesa

[57] ABSTRACT

A humidifier pad is disclosed which comprises a body portion having opposing surfaces. In the body portion there are a plurality of openings which allow communication between one of the surfaces to another of the surfaces. A pluality of projections extend from at least one of the surfaces. The pad may be formed in the shape of a drum wherein the drum comprises one or more pads placed within one another. Flexible plastic material which resists hydrolytic aging may be used in the manufacture of the pad to provide the consumer with a long-lasting easily maintained unit.

6 Claims, 6 Drawing Figures

HUMIDIFIER PAD

This is a continuation of application Ser. No. 419,122, filed Nov. 26, 1973, now abandoned.

FIELD OF INVENTION

This invention relates to a humidifier pad which may be adapted for use in various types of humidifiers.

BACKGROUND OF THE INVENTION

Humidifiers are used in both industrial and domestic applications to condition the air so that the relative humidity of the air falls within a comfortable range particularly during seasons when the air is very dry. Common to most humidifiers is the use of a humidifier pad or wick which disperses water so that the water may be evaporated into a moving stream of air which is circulated through a house or industrial area to humidify the air. In most applications, the water used to feed a humidifier has some degree of hardness, which causes caking of the humidifier pad or wick and associated parts with mineral deposits and the like. It is therefore necessary to clean a humidifier on a regular basis to prevent an undesirable buildup of deposits in the humidifier and maintain the proper working efficiency of the humidifier. A week acid solution may be used to break up or dissolve the deposits, however, with a wick type humidifier pad the cloth material degenerates with repeated washings.

Other types of humidifier pads such as the common polyurethane foam type are also subject to degeneration because the polyurethane foam undergoes hydrolytic aging and, as a result, the foam material deteriorates rapidly to give only one or two seasons of use. In addition, cleaning problems arise because the mineral deposits tend to collect in the inner portion of the foam pad thereby making it difficult to remove such deposits and, as a result, cut down on the efficiency of the humidifier. A further problem associated with the use of foam type humidifier pads is that the foam is not self-supporting therefore a stainless steel wire cage or the like is required to support the pad in the humidifier and, consequently, the cage itself becomes caked with mineral deposits, thereby making replacement of the humidifier pad difficult.

In foamed humidifier pads, particularly those made from polyurethane foam, the prescribed pore size has been found to vary from pad to pad so that a variance in the humidifying efficiency of each pad results. This type of variance may become critical in industrial applications because of undesirable overworking of humidifier units if the efficiency drops.

The humidifier pad according to this invention has been designed to overcome these problems. The humidifier pad is made from a flexible, preferably plastic material, comprising a body portion with two opposing surfaces. The body portion has a plurality of unobstructed openings which allow communication between one of the surfaces and the other where the cross-sectional area of the openings is sufficient to permit a water film to span the openings as the respective openings emerge from the water bath. A plurality of projections may extend from at least one of the surfaces, the projections being needle-like or of other configurations such as continuous ribs extending beyond the surfaces to increase the surface area of the water film to be evaporated. The humidifier pad may be molded to form any type of structure such as the typical drum unit wherein one or more layers of the humidifier pad may be placed one within the other to form a desired drum wall thickness to disperse the required amount of water.

The plastic material used in forming a humidifier pad according to this invention should be flexible with some degree of resiliency so that the pad essentially retains its shape. Preferably the plastic material so used should be resistant to attack by weak acid solutions so that cleaning of a humidifier pad is easily done to break up and dissolve mineral deposits on the element. Also, during the cleaning step the flexible pad may be flexed or deformed to break the mineral deposits off the body portion. The broken-up mineral deposits may be easily removed due to the fact that all surfaces on any one layer of the humidifier pad are exterior. A wide range of plastic materials are available which may be used to form the humidifer pad and there are materials available which are substantially resistant to hydrolytic aging and, as a result, if properly cleaned, may be used in a humidifier for several seasons. Also, the pore size in the humidifier pad may be closely controlled due to the pad being preferably made by a plastic molding or extruding process, thereby resulting in a product with a substantially consistent pore size. Materials used in forming a drum-shaped humidifier pad are chosen on the basis that the worked material retains its shape and does not sag so that means may be provided on the drum for mounting the drum-shaped pad in a humidifier, eliminating the need for a stainless steel wire cage or the like.

SUMMARY OF THE INVENTION

It is therefore an object of the invention to provide a humidifier pad which is easily maintained.

It is another object of the invention to provide a humidifier pad which retains its shape and does not sag and which withstands cleaning during several seasons of use.

It is yet another object of the invention to provide a humidifier pad formed from a suitable plastic material which resists hydrolytic aging and attack by weak acid cleaning solutions.

It is a further object of the invention to provide a humidifier pad having a pore size which may be controlled and of a configuration which permits the pad to be formed by plastic molding or extrusion processes.

BRIEF DESCRIPTION OF THE DRAWINGS

These and other objects, features and advantages of the invention are discussed in more detail hereinafter in association with the accompanying drawings in which.

DETAILED DESCRIPTION OF THE PREFERRED EMBODIMENTS

Figure 1:
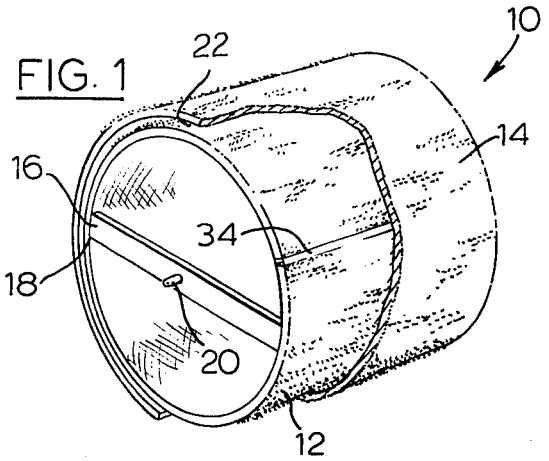
FIG. 1 is a partially sectioned perspective view of a preferred embodiment of a humidifier pad according to the invention.

A preferred embodiment of the invention is illustrated in FIG. 1 wherein a drum shaped humidifier pad 10 is shown as having a first inner layer 12 and a second outer layer 14. The second layer 14 is provided with a cross piece 16 at each end thereof and is attached to the inside thereof at point 18. An axle 20 is provided on the cross-member 16 where the axis of the axis 20 is coincident with the longitudinal axis of the humidifier drum 10. The axles 20 are so formed to fit in supporting and/or driving collars of the humidifier to be used. Although not shown, it is understood that an end of the humidifier drum 10 may be closed or sealed off by means of a solid sheet of material or by similar material which is used to form the cylindrical wall 22 of the humidifier drum in accordance with accepted practice.

Figure 2:
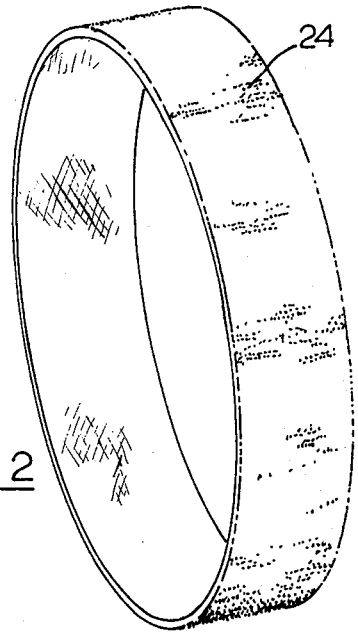
FIG. 2 is a perspective view of an alternative embodiment of the invention.

FIG. 2 shows an alternative form in which the humidifier pad according to this invention is used which may consist of one or more layers although, as illustrated, consists of one pad layer 24. Depending upon the usage of this configuration, either end of the pad 24 may be closed off with a solid sheet of material or with material similar in structure which forms the body portion of pad 24.

Figure 5:
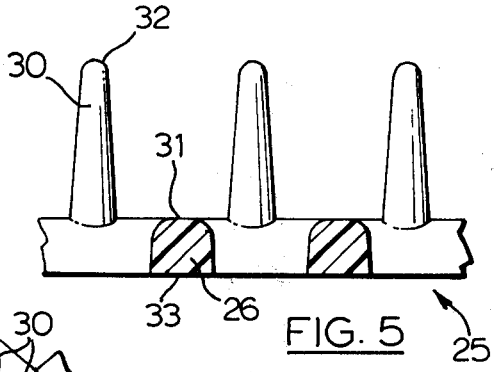
FIG. 5 is a partial cross section along the line 5—5 in FIG. 4 of the humidifier pad.
Figure 4:
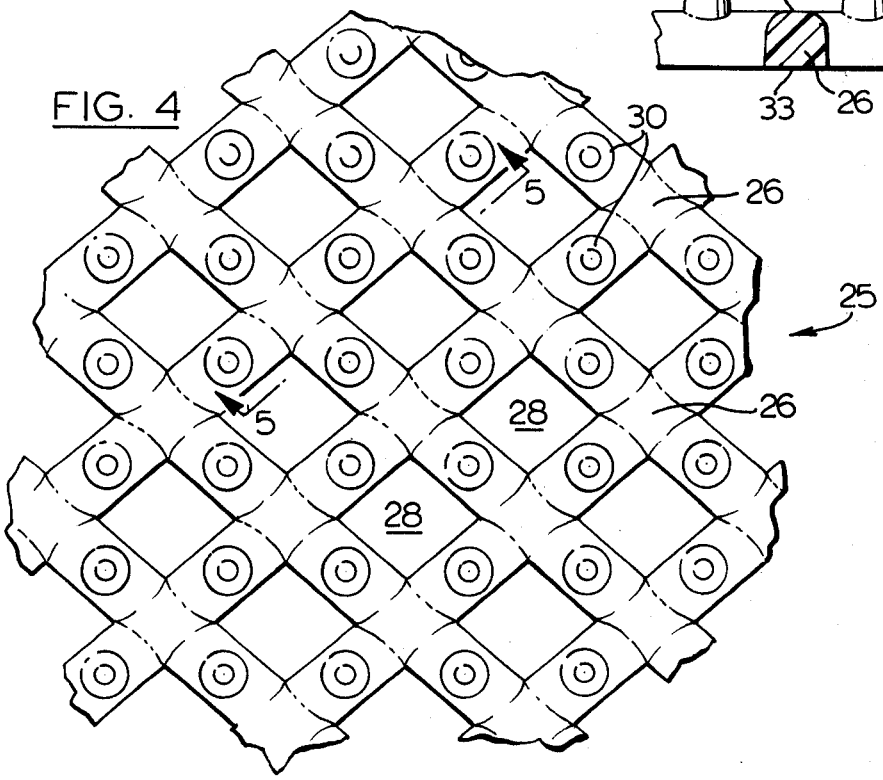
FIG. 4 is an enlarged top view of a section of the humidifier pad as illustrated in FIG. 2.

A more detailed view of the structure of the body portion of humidifier pad 24 and of humidifier pad layers 12 and 14 of FIG. 1, is shown in an enlarged view in FIG. 4. The structure comprises a body portion 25 formed of a series of criss-crossing members 26 which define a plurality of openings 28. As shown, the openings 28 are diamond-shaped, however, it is understood that other opening shapes may be used such as circles or ovals depending upon design requirements. A cross-section of the structure along the lines 5—5 is shown in FIG. 5 where the projections 30 are shown as having tips 32. Members 26 of the body portion 25 are substantially rectangular in cross-section, each having an upper surface 31 and a lower surface 33. The outer and inner surfaces of body portion 25 are therefore defined by the plurality of upper surfaces 31 and the plurality of lower surfaces 33 respectively where the unobstructed openings 28 allow communication between the outer and inner surfaces.

The spacing of the openings as shown in FIG. 4 is such that a symmetrical pattern is produced. Depending upon the shape of the opening and the shape of the criss-crossing members defining the openings, the surface areas of the openings may be chosen such that they are of sufficient size to permit a flow of air to pass therethrough without causing undue pressure drop, and also be sufficiently small to permit the formation of a water film within or spanning the openings of any layer as the humidifier pad is rotated in a water bath. Depending on the uniformity of the openings and the speed of rotation of the humidifier drum 10, it is possible that not all of the openings emerging from the water bath are spanned with a water film. By having the drum as illustrated in FIG. 1 located in a humidifier such that the lower portion thereof passes through the water bath and air is forced through the drum openings 28, the water film and droplets suspended in or spanning the openings 28 and on the body portion 25 are evaporated into the moving current of air thereby humidifying same.

Figure 3:
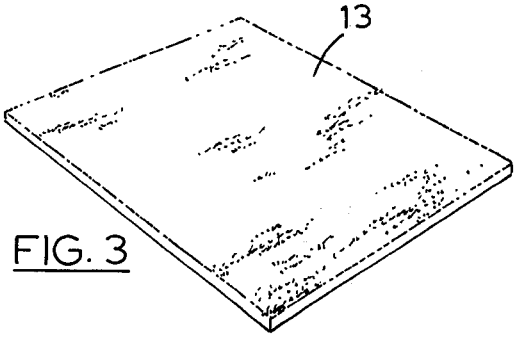
FIG. 3 is a perspective view of the humidifier pad according to this invention in the form of a flat sheet.

FIG. 3 illustrates a flat sheet of material 13 of a structure shown in FIG. 4 from which various forms of humidifier pads may be made and from which other forms may be made for use in assisting the evaporation of any type of liquid.

To increase the thickness of the drum wall 22 of the humidifier drum shown in FIG. 1, an additional hollow cylindrical pad layer may be inserted on the inside of the outer layer 14 by cutting a flat sheet 13 of an appropriate width to the correct circumferential length and folding it so that it fits between cross-member 16 and the upper or lower circumferential edge of the second outer layer 14 and allowing it to unfold and take on the shape of the inside surface of the outer layer 14. When a humidifier pad layer such as 12 is placed within the second outer layer 14, the tips 32 of the projections touch the inner surface of the outer layer 14, thereby spacing the body portion of the two humidifier pads apart. The inner layer 12 may be positioned so that the openings 28 therein do not exactly line up with the openings 28 of the outer pad 14. This creates a cascading action with the water as the air passes through the non-aligned openings where the water is transferred from one pad to the next along projections 30 by capillary action or by gravitational force. The projections 30 also serve to increase the quantity of water to be evaporated by providing a greater surface area to which water film or droplets may adhere.

As is apparent, more than one humidifier pad layer such as 12, may be placed within the outer layer 14 so that with the drum constructions of FIG. 1, a further layer may be placed within layer 12 where an open seam would be formed along the length of each further pad such as seam 34 along layer 12. It is understood that variations in the dimensions and configurations of humidifier drum or pad constructions may be made wherein a humidifier pad body portion according to this invention is used.

The humidifier pad as shown in FIG. 2 is rigid yet has a degree of flexibility depending upon the type of material used in forming the pad. The body portion of the pad as shown in FIG. 4 is not porous so that in fitting such a pad over a stainless steel wire cage or sleeve, the inside surface of the pad is not torn by mineral deposits or rough edges of the cage. This is contrary to what is usually experienced in installing a humidifier pad of foamed construction because the mineral deposits and rough edges on the supporting structure easily tear the foam thereby hindering proper installation. Therefore, the humidifier pad of FIG. 2 may be easily installed on a wire cage or the like without tearing and in addition, it may be adapted to be supported by a support assembly similar to that shown in FIG. 1.

Figure 6:
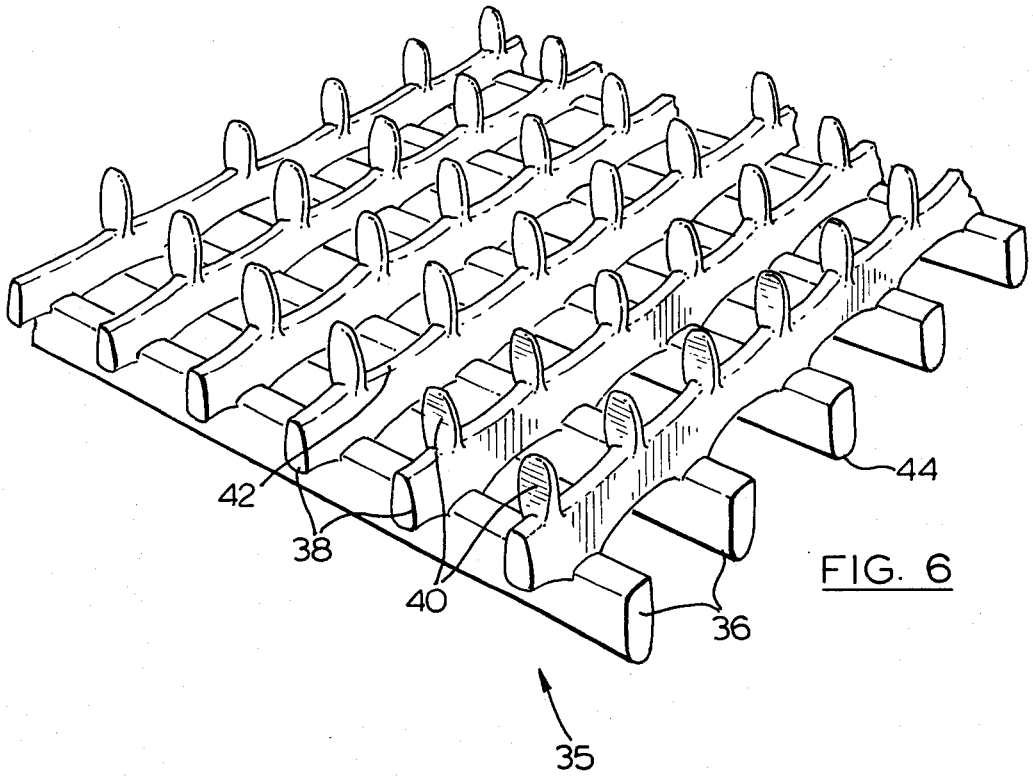
FIG. 6 is a perspective view of a segment of another embodiment of the humidifier pad material according to this invention.

Alternative configurations of the structure of the body portion of the humidifier pad may be used such as the section of a body portion shown in FIG. 6. The body portion 35 consists of a plurality of spaced-apart substantially parallel members 36 and integrally connected to and on top of members 36 is a plurality of members 38 each of which crosses members 36 at substantially right angles. Each member 38 has a plurality of projections 40 extending outwardly therefrom. Each of the members 36 and 38 proximate a substantially rectangular cross-section wherein members 38 are slightly tapered towards the upper surfaces 42 thereof. The upper surfaces 42 define the outer surface of the body portion 35 and the lower surfaces 44 of members 36 define the inner surface of the body portion 35 where the openings between members 38 in the outer surface and the openings between members 36 allow communication between the inner and outer surfaces. The principles which apply to the satisfactory performance of the body portion configuration of FIG. 6 as used in a humidifier drum or pad, such as shown in FIG. 1, are the same as those discussed hereinabove in relation to the section of the humidifier pad shown in FIG. 4.

The materials from which humidifier pad structures according to this invention may be made, are assorted plastics which are flexible, such as polyethylene or polypropylene and, as discussed hereinabove, substantially resist hydrolytic aging. The material once formed in the desired shape of a humidifier pad should have a certain degree of resiliency so that the pad will return or at least attempt to return, to its originally formed position. Due to the flexibility of the humidifier pad, cleaning thereof is easily effected upon removal of the unit from the humidifier device. The humidifier pad may be immersed in a weak acid solution to dissolve or break up the mineral deposits from the body portion of the pad and also upon flexing of the pad, the mineral deposits tend to flake off from the body portion, leaving the unit substantially deposit-free. Cleaning of a humidifier pad such as that illustrated in FIG. 1 may be easily carried out by removing the inner pad 12 to ensure that the deposits are cleaned off both pads and that none of the deposits become lodged between the two pads. Therefore a humidifier pad of a construction according to this invention provides the consumer with a long-lasting unit which is easily maintained.

While various embodiments of the invention have been illustrated and described, it will be understood that variations therein may be made as will be apparent to those skilled in the art without departing from the spirit of the invention or the scope of the appended claims.

I claim:

1. In a humidifier having a housing, a water reservoir in said housing, means for directing a flow of air to be humidified through said humidifier, and a hollow cylindrical shaped humidifier pad mounted in said housing for rotation therein, a lower portion of said humidifier pad being immersed in water contained in said water reservoir, said humidifier pad comprising a network of criss-crossing flexible plastic ribs which define a plurality of unobstructed openings extending from an inner surface to an outer surface of said humidifier pad which permits communication between said inner and outer surfaces, and a plurality of substantially even length projections extending outwardly from at least one of said inner or outer surfaces, said projections being integrally molded to said criss-crossing ribs, all surfaces of said humidifier pad being external of the pad, said unobstructed openings being of sufficient cross-sectional area to permit a flow of air therethrough from one of said surfaces to the other of said surfaces where a water film spans an unobstructed opening to present water to said flow of air to be humidified, said network of criss-crossing plastic ribs being formed of a plastic which is sufficiently rigid so that said hollow cyclindrical shaped humidifier pad is self-supporting and which is sufficiently flexible to permit flexing of said humidifier pad and cause distortion of said ribs to release scale from the external surfaces of said pad, the flexible humidifier pad attempting to recover its original cylindrical shape after flexing of the pad.

2. In a humidifier of claim 1 said pad being drum-shaped and comprises more than one of said cylindrical shaped pads, the diameters of the substantially cylindrical pads being progressively less in length to permit one cylindrical pad to be inserted within the other thereby forming a plurality of concentric substantially cylindrical pads.

3. In a humidifier of claim 2 a plurality of said projections extend from said outer surface of each of said substantially cylindrical pads, the difference in said diameters being such that when said cylindrical pads are placed one within the other, said projections on said outer surface of one of said cylindrical body portions contacts the inner surface of the outwardly adjacent cylindrical pad.

4. In a humidifer of claim 2 means for supporting said drum-shaped humidifier pad for rotational movement within a humidifier is provided on said humidifier pad.

5. In a humidifier of claim 1 said openings have a cross-sectional area sufficiently small to permit a water film to span each of said openings as the respective openings emerge from a water bath.

6. In a humidifier of claim 1 said pad of plastic material being substantially resistant to hydrolytic aging.

* * * * *